US009442462B2

(12) United States Patent
Edmondson et al.

(10) Patent No.: US 9,442,462 B2
(45) Date of Patent: Sep. 13, 2016

(54) PERSONALIZED WALL CLOCKS AND KITS FOR MAKING THE SAME

(75) Inventors: David Edmondson, San Diego, CA (US); Xiaoqi Zhou, San Diego, CA (US); Stephen Martin Ledak, Santee, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 127 days.

(21) Appl. No.: 14/366,149

(22) PCT Filed: Dec. 20, 2011

(86) PCT No.: PCT/US2011/066147

§ 371 (c)(1),
(2), (4) Date: Jun. 17, 2014

(87) PCT Pub. No.: WO2013/095379

PCT Pub. Date: Jun. 27, 2013

(65) Prior Publication Data

US 2015/0023141 A1 Jan. 22, 2015

(51) Int. Cl.
*G04B 19/04* (2006.01)
*G04B 19/06* (2006.01)
(Continued)

(52) U.S. Cl.
CPC ..... *G04B 19/06* (2013.01); *G04B 19/04* (2013.01); *G04B 19/042* (2013.01); *G04B 19/12* (2013.01); *G04B 45/0076* (2013.01); *G04B 47/00* (2013.01)

(58) Field of Classification Search
CPC .... G04B 19/00; G04B 19/04; G04B 19/042; G04B 19/06; G04B 19/08; G04B 19/10; G04B 19/12; G04B 45/0076; G04B 47/00
See application file for complete search history.

(56) References Cited

U.S. PATENT DOCUMENTS 2,085,097 A 6/1937 Hansen
2,170,723 A * 8/1939 Marx ..... B65D 5/2004 229/167

(Continued)

FOREIGN PATENT DOCUMENTS

GB 2461863 1/2010
KR 2019880018408 10/1988

(Continued)

OTHER PUBLICATIONS

"Snow-Design", http://snow-design.com/haco-tukuru.html, Aug. 28, 2011, retrieved from the internet Dec. 12, 2015.*

(Continued)

*Primary Examiner* — Vit W Miska
(74) *Attorney, Agent, or Firm* — Dierker & Kavanaugh, P.C.

(57) ABSTRACT

Personalized wall clocks and kits for making the same are disclosed herein. A kit includes an image receiving medium to receive thereon a personalized digital printed image. The image receiving medium includes a digital ink/toner receiving layer or has a digital ink/toner receiving surface structure. The kit also includes a foldable material which includes a face portion having two opposed surfaces and at least four sides. One opposed surface is to receive the image receiving medium. The foldable material includes a foldable extension extending from each side of the face portion. Each foldable extension is to be folded no less than four times toward another of the opposed surfaces to form a three-dimensional supporting frame. The kit includes a hand-moving mechanism.

19 Claims, 5 Drawing Sheets

(51) Int. Cl.

| | |
|---|---|
| ***G04B 19/12*** | (2006.01) |
| ***G04B 47/00*** | (2006.01) |
| ***G04B 45/00*** | (2006.01) |

(56) References Cited

U.S. PATENT DOCUMENTS

| | | | | | |
|---|---|---|---|---|---|
| 2,445,280 | A | * | 7/1948 | Powell | A47F 5/112 206/594 |
| 3,563,369 | A | * | 2/1971 | Aldrich | B65D 5/5011 206/301 |
| 3,733,809 | A | | 5/1973 | Reiter et al. | |
| 3,853,216 | A | * | 12/1974 | Jaeschke | B65D 5/18 206/301 |
| 3,889,806 | A | * | 6/1975 | Casella | G04B 37/00 206/301 |
| 4,899,324 | A | | 2/1990 | Barbieri et al. | |
| 5,142,512 | A | * | 8/1992 | Takano | G04B 45/0084 368/232 |
| 5,303,211 | A | | 4/1994 | Yanaka et al. | |
| 5,516,581 | A | * | 5/1996 | Kreckel | A47G 1/175 428/317.3 |
| 5,754,499 | A | * | 5/1998 | Lin | G04B 37/0066 368/236 |
| 6,160,767 | A | | 12/2000 | Ho | |
| 6,807,129 | B1 | | 10/2004 | Chan | |
| 7,016,865 | B1 | | 3/2006 | Weber et al. | |
| 7,267,480 | B1 | * | 9/2007 | Hasson | G04B 19/10 368/228 |
| 2003/0001846 | A1 | | 1/2003 | Davis et al. | |
| 2003/0210614 | A1 | * | 11/2003 | Cooper | G04B 47/046 368/223 |
| 2010/0118662 | A1 | | 5/2010 | Smith | |
| 2011/0016759 | A1 | | 1/2011 | Ramos-Gonzalez et al. | |

FOREIGN PATENT DOCUMENTS

| | | |
|---|---|---|
| KR | 2019910001253 | 1/1991 |
| KR | 200340284 | 1/2004 |

OTHER PUBLICATIONS

Internet Archive of http://snow-design.com/haco-tukuru.html, retrieved from the internet Dec. 12, 2015.*

3D printing: The printed world, "Three-dimensional printing from digital designs will transform manufacturing and allow more people to start making things", The Economist, 2011, 8 pages, http://www.economist.com/node/18114221.

"Fine Art Quality Clock Dials", 2009, 3 pages, http://www.clockprints.com.

* cited by examiner

PERSONALIZED WALL CLOCKS AND KITS FOR MAKING THE SAME

BACKGROUND

The present disclosure relates generally to personalized wall clocks and kits for making the same.

Analog wall clocks have a dial or face, which is marked with hour markings. Hands sweep over the dial pointing to the hour markings indicating the then-current time of day. Clock dials are often blank or have limited designs, apart from the hour markings. This may be due, at least in part, to the fact that commercially available wall clocks are often created during a large volume production.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Examples of the personalized wall clock disclosed herein are personalized with a person's photograph(s), his/her selected text, his/her selected graphics, and combinations thereof. As such, the personalized wall clock may reflect a particular person's taste, his/her home décor, and/or a special event (e.g., a new baby, a birthday, graduation, wedding, anniversary, etc.). The kit disclosed herein enables one to generate the personalized wall clock at a low cost, in a speedy fashion, and without special skill or training. The personalized wall clock is extremely light weight compared to, for example, a clock made of metal, ceramic composites, plastic, wood, or other traditional clock materials. In an example, the weight of the personalized wall clock (excluding the battery) ranges from about 150 g to about 500 g.

Figure 1:
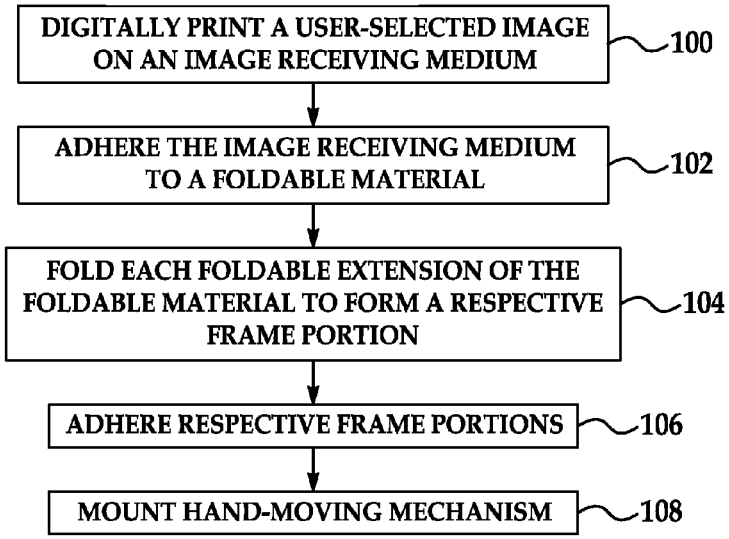
FIG. 1 is a flow diagram depicting an example of making a personalized wall clock.

Referring now to FIG. 1, an example of a method for making a personalized wall clock is depicted. As shown at reference numeral 100, a user-selected image is digitally printed on an image receiving medium. The image receiving medium (having the digital image printed thereon) is adhered to a foldable material, as shown at reference numeral 102. In an example, the foldable material may have a pre-applied polymeric pressure sensitive adhesive applied thereon which adheres the image receiving medium to the foldable material when the image receiving medium is placed into contact with the foldable material. Foldable extensions of the foldable material are folded to form respective frame portions (reference numeral 104), and the respective frame portions are adhered to the foldable material (reference numeral 106). As shown at reference numeral 108, a hand-moving mechanism is mounted to the foldable material to form the personalized wall clock. It is to be understood that the various steps of the method will be further described in more detail in reference to FIGS. 2-7.

Figure 2:
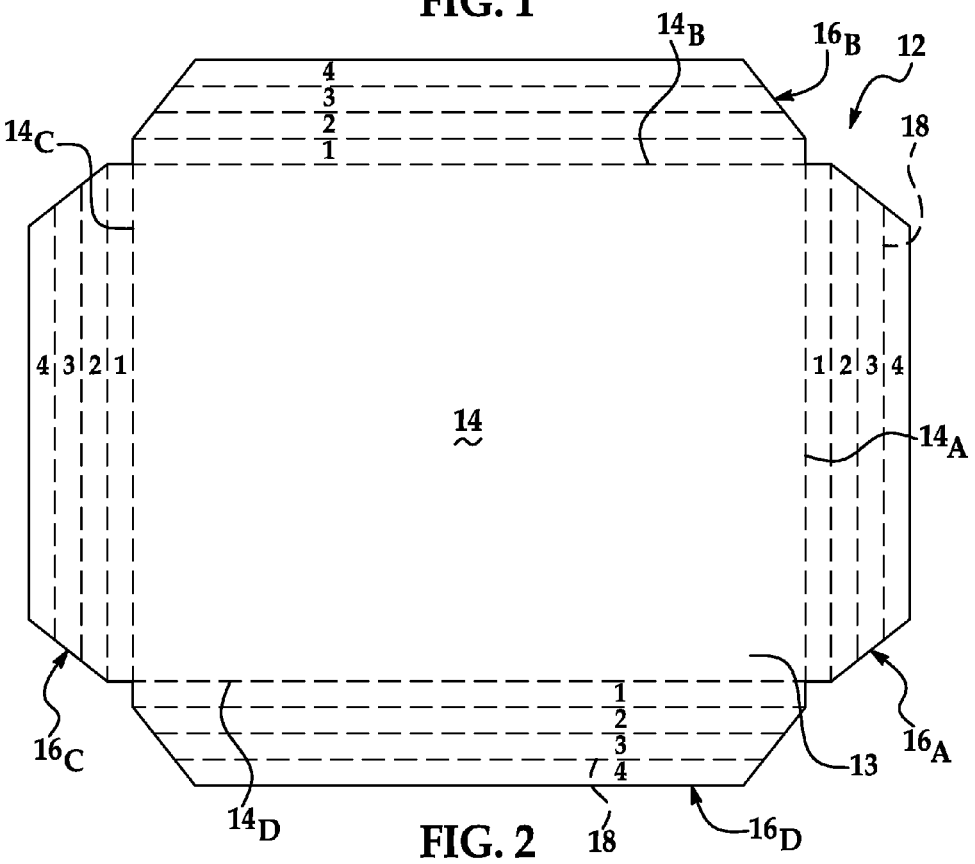
FIG. 2 is a front view of an example of a foldable material that is used to form an example of a three-dimensional supporting frame.

FIG. 2 is a front view of a foldable material 12 having a face portion 14. The face portion 14 has two opposes surfaces 13 (shown in FIG. 2), 15 (shown in FIG. 4A) and at least four sides $\mathbf{14}_A$, $\mathbf{14}_B$, $\mathbf{14}_C$, $\mathbf{14}_D$. When the face portion 14 has four sides $\mathbf{14}_A$, $\mathbf{14}_B$, $\mathbf{14}_C$, $\mathbf{14}_D$, the face portion may be square or rectangular. When the face portion 14 has more than four sides, the shape of the face portion 14 will depend upon the number of sides (e.g., five sides correspond with a pentagon shaped face portion 14).

A foldable extension $\mathbf{16}_A$, $\mathbf{16}_B$, $\mathbf{16}_C$, $\mathbf{16}_D$ respectively extends from each side $\mathbf{14}_A$, $\mathbf{14}_B$, $\mathbf{14}_C$, $\mathbf{14}_D$ of the face portion 14. The foldable extensions $\mathbf{16}_A$, $\mathbf{16}_B$, $\mathbf{16}_C$, $\mathbf{16}_D$ may be scored with fold lines 18 that are meant to guide the folding of the foldable extensions $\mathbf{16}_A$, $\mathbf{16}_B$, $\mathbf{16}_C$, $\mathbf{16}_D$ toward the side 15 of the face portion 14. In an example, each foldable extension $\mathbf{16}_A$, $\mathbf{16}_B$, $\mathbf{16}_C$, $\mathbf{16}_D$ has four fold lines 18 defining four respective tabs 1, 2, 3, 4. In this example then, each foldable extension $\mathbf{16}_A$, $\mathbf{16}_B$, $\mathbf{16}_C$, $\mathbf{16}_D$ is foldable four times, once along each scored fold line 18. In other examples, it is to be understood that more than four fold lines 18 may be included on any one foldable extension $\mathbf{16}_A$, $\mathbf{16}_B$, $\mathbf{16}_C$, $\mathbf{16}_D$ so that the foldable extension $\mathbf{16}_A$, $\mathbf{16}_B$, $\mathbf{16}_C$, $\mathbf{16}_D$ is foldable at least four times.

Figure 4A:
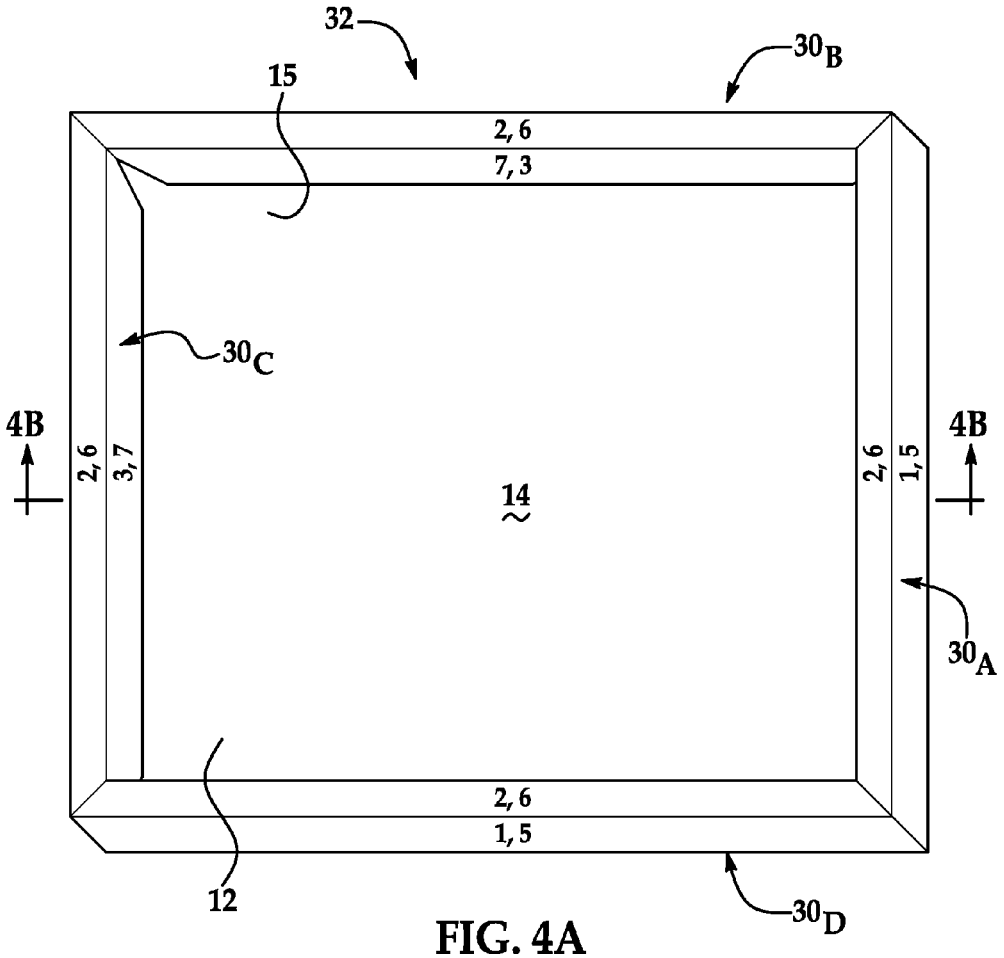
FIG. 4A is a back, perspective view of an example of the foldable material having the image receiving medium adhered thereon after the foldable material and image receiving medium are folded to form an example of the three-dimensional supporting frame.

The foldable extensions $\mathbf{16}_A$, $\mathbf{16}_B$, $\mathbf{16}_C$, $\mathbf{16}_D$ and the tabs 1, 2, 3, 4 may have any suitable shape that allows the tabs 1, 2, 3, 4 of the respective the foldable extension $\mathbf{16}_A$, $\mathbf{16}_B$, $\mathbf{16}_C$, $\mathbf{16}_D$ to be folded toward the surface 15 to form a three-dimensional frame portion (see FIG. 4A). In an example, each frame portion abuts another frame portion to form the three-dimensional supporting frame that is ultimately formed from the foldable material 12.

The foldable material 12 may be made of any foldable material with suitable stiffness that can be folded over at least 90° with the assistance of scoring without cracking and/or breaking. The stiffness of the foldable material 12 ranges from about 1000 Taber units to 2500 Taber units (TAPPI method T489-om). Stiffness, k, of a body is a measure of the resistance offered by an elastic body to deformation. For an elastic body with a single degree of freedom (for example, stretching or compression of a rod), the stiffness, k, is defined as $$k = \frac{F}{\delta}$$

where F is the force applied on the body and δ is the displacement produced by the force along the same degree of freedom. Examples of the foldable material 12 include pure element materials, such as aluminum foil; compounds of multiple elements, such as copper-zinc alloy foil; synthetic polymers, such as toughened polypropylene; natural products, such as cellulose paper (e.g., cardboard); or composites, such as polyethylene terephthalate/calcium carbonate (PET/$CaCO_3$) coextruded sheets.

Figure 3A:
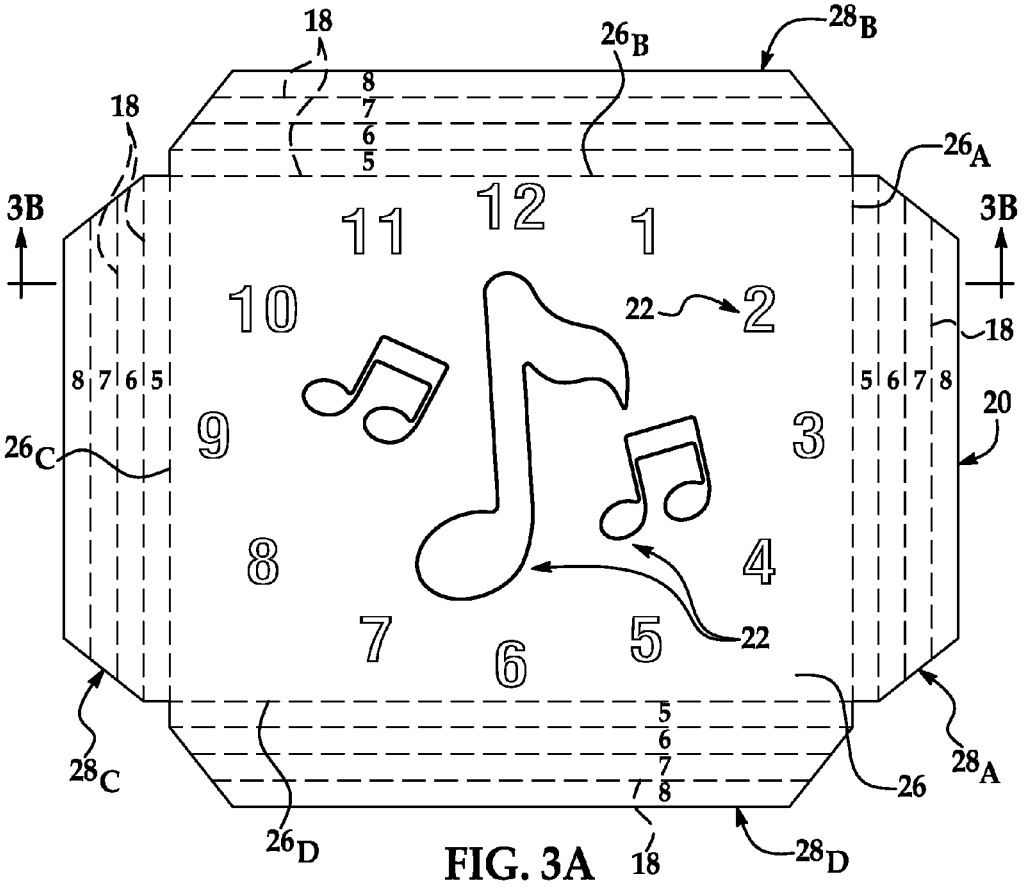
FIG. 3A is a front view of an example of an image receiving medium, having an example of a digitally printed image printed thereon, adhered to the foldable material of FIG. 2.
Figure 3B:
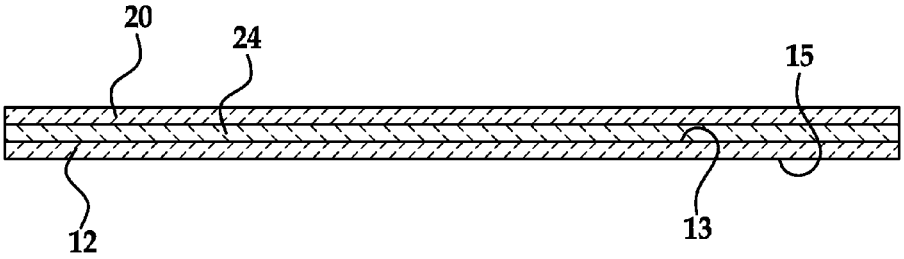
FIG. 3B is a cross-sectional view taken along the 3B-3B line of FIG. 3A.

Referring now to FIGS. 3A and 3B, an image receiving medium 20, having an image 22 digitally printed thereon, is shown adhered to the foldable material 12. In this example, the image receiving medium 20 and the foldable material 12 are the same shape and size. As such, in FIG. 3A, the image receiving medium 20 alone is visible (as the foldable material 12 is underlying the image receiving medium 20). The matching size and shape of the materials 12 and 20 enables a user to easily align the two materials 12 and 20 using the edges. In other examples, the image receiving medium 20 is the same size and shape as the face portion 14, or the same size and shape as the face portion 14 and the innermost tab 1 of the foldable extensions $\mathbf{16}_A$, $\mathbf{16}_B$, $\mathbf{16}_C$, $\mathbf{16}_D$.

The image receiving medium 20 is a medium that is suitable for use with any digital printing device, such as a digital inkjet printer, a liquid electrophotographic printer (a liquid toner printer), or an electrophotographic printer (a dry toner laser printed). Any of these printers may be utilized to print the image 22, which may be based upon a digital image (e.g., a digital photograph) and/or may include text (e.g., the numbers shown in FIG. 3A) and/or graphics (e.g., the musical notes shown in FIG. 3A).

The image receiving medium 20 is a foldable material which has a specific surface that is able to receive a digital image with high print quality. The specific surface may be made by coating or depositing a digital ink/toner receiving layer onto the outermost surface of a base substrate. In this example, coating or depositing refers to the application of a specifically formulated chemical composition onto the outermost surface of the base substrate of the image receiving medium 20 by a suitable process which includes any type of coating process. The specific surface may also be made by surface treating the base substrate via a physical and/or chemical process (e.g., corona treatment, plasma grafting polymerization and/or acid etching). In this example, surface treating refers to a method for altering the surface structure or morphology chemically and/or physically without applying any foreign composition to cover the surface of the base substrate. The surface treating method modifies the nature of the base substrate surface by changing the surface morphology or changing the surface chemical functional groups.

In one example, the image receiving medium 20 includes a cellulose paper base, and the outermost surface of the cellulose paper base is surface functionalized with a digital ink/toner receiving layer. The composition of the digital ink/toner receiving layer may include binder(s) and inorganic pigment particle(s).

The binder used in the digital ink/toner receiving layer is selected from water-based binders. In one example, suitable water-based binders include polyvinyl alcohol, styrene-butadiene emulsion, acrylonitrile-butadiene latex, or combinations thereof. In addition to the binder(s) listed above, other suitable water-based binders may also be added including: starch (e.g., oxidized starch, cationized starch, esterified starch, enzymatically denatured starch, etc.), gelatin, casein, soybean protein, cellulose derivatives (e.g., carboxy-methyl cellulose, hydroxyethyl cellulose, etc.), acrylic emulsion, vinyl acetate emulsion, vinylidene chloride emulsion, polyester emulsion, and polyvinylpyrrolidone. The amount of the binder in the digital ink/toner receiving layer ranges from about 4% to about 25% by dry weight of the digital ink/toner receiving layer. In one example, the amount of the binder in the digital ink/toner receiving layer ranges from about 5% to about 15% by dry weight.

The inorganic pigment particles used in the digital ink/toner receiving layer may be selected from clay, kaolin, calcium carbonate, or combinations thereof. Other particles that may be added include talc, alumina, silica titanium dioxide, zeolite, organic pigments (e.g., polyethylene, polymethyl methacrylate, and TEFLON® powders), and the combination of the particles. The total amount of particles ranges from about 60% to about 95% by total dry weight of the digital ink/toner receiving layer. In one example, the total amount of particles ranges from about 70% to about 85% by total dry weight of the digital ink/toner receiving layer.

The digital ink/toner receiving layer may be subjected to an embossing treatment to create a desirable surface texture which is represented by a lay pattern. "Lay" is a measure of the direction of the predominant machining pattern. A lay pattern is a repetitive impression created on the surface of a part. The lay patterns created on the image receiving medium 20 include, for example, vertical patterns, horizontal patterns, radial patterns, circular patterns, isotropic patterns and cross hatched patterns.

In another example, the image receiving medium 20 is made of a foldable material based on a polymeric film. Examples of suitable polymeric films include polyolefin films (e.g., polyethylene and polypropylene films), polycarbonate films, polyamide films, polytetrafluoroethylene (PTFE) films. These polymeric films can be used or alone, or they can be co-extruded with another material, such as cellulose paper, to form a foldable composite. In some examples, the polymeric film surface is pre-coated with an example of the digital ink/toner receiving layer disclosed herein and/or is surface treated to improve the ink reception and toner adhesion.

In yet another example, the image receiving medium 20 is made of a foldable ductal metal foil. The metal foil may be a pure metal and/or a metal alloy. In some examples, the metal foil surface is pre-coated with an example of the digital ink/toner receiving layer disclosed herein and/or is surface treated to improve the ink reception and toner adhesion.

Any of the digital ink/toner receiving layers disclosed herein may include components that absorb light in the ultraviolet (UV) and violet region (200 nm to 380 nm) of the electromagnetic spectrum, and re-emit light in the blue region (400 nm to 490 nm). Without being bound to any theory, it is believed that when the printed image (which does not include any of these absorption compounds) is illuminated under certain wavelengths of light (e.g., 400 nm to 475 nm), the light re-emission of the components in the medium 20 help to build a spectrum difference between image receiving medium 20 and the printed image. Such a difference visually appears as and/or enhances a three-dimensional (3D) effect. The chemical compounds which are able to absorb and then re-emit include those that have the structure of any of the following: triazine-stilbenes (di-, tetra- or hexa-sulfonated); coumarins; imidazolines; diazoles; triazoles, benzoxazolines; or biphenyl-stilbenes.

Any of the digital ink/toner receiving layers disclosed herein may also include luminous materials. As an example, when illuminated by the particular wavelength(s) of light for a particular amount of time, the luminous materials will exhibit a specific light effect (e.g., photoluminescence) after the light is removed. Some examples of the luminous materials include Tritium, LumiNova, and Super LumiNova.

It is to be understood that the surface appearance of the final personalized clock 10 depends, at least in part, upon the surface of the image receiving medium 20 that is used. The surface of the medium 20 may be smooth and glossy/shiny, or satin, or matte, or some other textured surface (e.g., patterned as described above). A satin surface may be created, for example, by including a matte agent in the digital ink/toner receiving layer. Examples of a matte agent include fillers (e.g., ground calcium carbonate, clay, or organic beads, such as polyethylene dispersions) with large particle size (from about 20 μm to about 50 μm). In one example, the matte agent is hollow polymeric particles, where from about 20% to about 60% of particle volume is occupied by air voids.

The desired surface appearance may also be created by surface texturing the medium 20 using a calendering process. The medium 20 is passed through a single nip or multiple nips under pressure, where one roll contacts the outermost surface of the medium 20. The roll is etched with a surface pattern or is matted, and a mirror image of the pattern/matte is transferred to the image receiving medium 20 under pressure.

As mentioned above, the image 22 may be created using any suitable digital printing technique. It is believed that the durability of the printed image 22 may be the result of the combination of the medium 20 and the ink or toner that is used. For example, a medium 20 including a digital ink/toner receiving layer or having been surface treated may be desirable when digital electrophotographic printing is used with toners that contain a durable colorant and UV, light and ozone fastness resin binders. In these examples, when the toner particles are heated after having been transferred to the image receiving medium 20 (with surface treatment and/or the coated ink/toner receiving composition), the binder in the toner can form a continuous film which embeds the colorant and thus protects the colorant from any harmful environmental attack.

In another example, a durable printed image 22 is formed when a pigment inkjet ink is printed, using inkjet technology, onto a micro-porous image receiving medium 20. In this example, a pigment or any number of pigment blends may be provided in the inkjet ink formulation to impart color to the ink. As such, the pigment may be any number of desired pigments dispersed throughout the resulting inkjet ink. More particularly, the pigment included in the inkjet ink may include self-dispersed (surface modified) pigments, or pigments accompanied by a dispersant.

Suitable pigments that may be included in the inkjet ink are black pigments, white pigments, cyan pigments, magenta pigments, yellow pigments, or the like. Further, the pigments may be organic or inorganic particles. Suitable inorganic pigments include, for example, carbon black, titanium oxide, cobalt blue ($CoO—Al_2O_3$), chrome yellow ($PbCrO_4$), and iron oxide. Suitable organic pigments include, for example, azo pigments including diazo pigments and monoazo pigments, polycyclic pigments (e.g., phthalocyanine pigments, such as phthalocyanine blues and phthalocyanine greens, perylene pigments, perynone pigments, anthraquinone pigments, quinacridone pigments, dioxazine pigments, thioindigo pigments, isoindolinone pigments, pyranthrone pigments, and quinophthalone pigments), insoluble dye chelates (e.g., basic dye type chelates and acidic dye type chelate), nitropigments, nitroso pigments, anthanthrone pigments (such as PR168), and the like. Examples of phthalocyanine blues and greens include copper phthalocyanine blue, copper phthalocyanine green and derivatives thereof (Pigment Blue 15 and Pigment Green 36). Examples of quinacridones include Pigment Orange 48, Pigment Orange 49, Pigment Red 122, Pigment Red 192, Pigment Red 202, Pigment Red 206, Pigment Red 207, Pigment Red 209, Pigment Violet 19 and Pigment Violet 42. Examples of anthraquinones include Pigment Red 43, Pigment Red 194 (Perinone Red), Pigment Red 177, Pigment Red 216 (Brominated Pyranthrone Red) and Pigment Red 226 (Pyranthrone Red). Examples of perylenes include Pigment Red 123 (Vermillion), Pigment Red 149 (Scarlet), Pigment Red 179 (Maroon), Pigment Red 190 (Red), Pigment Red 189 (Yellow Shade Red) and Pigment Red 224. Examples of thioindigoids include Pigment Red 86, Pigment Red 87, Pigment Red 88, Pigment Red 181, Pigment Red 198, Pigment Violet 36, and Pigment Violet 38. Examples of heterocyclic yellows include Pigment Yellow 1, Pigment Yellow 3, Pigment Yellow 12, Pigment Yellow 13, Pigment Yellow 14, Pigment Yellow 17, Pigment Yellow 65, Pigment Yellow 73, Pigment Yellow 74, Pigment Yellow 90, Pigment Yellow 110, Pigment Yellow 117, Pigment Yellow 120, Pigment Yellow 128, Pigment Yellow 138, Pigment Yellow 150, Pigment Yellow 151, Pigment Yellow 155, and Pigment Yellow 213. Some of the listed pigments are commercially available in either powder or press cake form from a number of sources including, BASF Corporation, Engelhard Corporation and Sun Chemical Corporation.

Examples of black pigments that may be used include carbon pigments. The carbon pigment may be any commercially available carbon pigment that provides acceptable optical density and print characteristics. Suitable carbon pigments include carbon black, graphite, vitreous carbon, charcoal, and combinations thereof. These carbon pigments can be manufactured by a variety of known methods, such as a channel method, a contact method, a furnace method, an acetylene method, or a thermal method, and are commercially available from such vendors as Cabot Corporation, Columbian Chemicals Company, Degussa AG, and E.I. DuPont de Nemours and Company. Suitable carbon black pigments include, Cabot pigments such as MONARCH® 1400, MONARCH® 1300, MONARCH® 1100, MONARCH® 1000, MONARCH® 900, MONARCH® 880, MONARCH® 800, MONARCH® 700, CAB-O-JET® 200, CAB-O-JET® 300, REGAL®, BLACK PEARLS, ELFTEX®, MOGUL®, and VULCAN® pigments; Columbian pigments such as RAVEN® 7000, RAVEN® 5750, RAVEN®5250, RAVEN®5000, and RAVEN® 3500; Degussa pigments such as Color Black FW 200, RAVEN® FW 2, RAVEN® FW 2V, RAVEN® FW 1, RAVEN® FW 18, RAVEN® S160, RAVEN® FW S170, Special Black 6, Special Black 5, Special Black 4A, Special Black 4, PRINTEX® U, PRINTEX® 140U, PRINTE®X V, and PRINTEX® 140V; and TIPURE® R-101 available from DuPont. The above list of pigments includes unmodified pigment particulates, small molecule attached pigment particulates, and polymer-dispersed pigment particulates.

Colored pigments may also be used in the inkjet inks that may be used to form the printed image 22. Example colored pigments may be blue, brown, cyan, green, white, violet, magenta, red, orange, yellow and mixtures thereof. The following suitable color pigments are available from Cabot Corp.: CABO-JET® 250C, CABO-JET® 260M, and CABO-JET® 270Y. The following suitable color pigments are available from BASF Corp.: PALIOGEN® Orange, PALIOGEN® Orange 3040, PALIOGEN® Blue L 6470, PALIOGEN® Violet 5100, PALIOGEN® Violet 5890, PALIOGEN® Yellow 1520, PALIOGEN® Yellow 1560, PALIOGEN® Red 3871 K, PALIOGEN® Red 3340, HELIOGEN® Blue L 6901 F, HELIOGEN® Blue NBD 7010, HELIOGEN® Blue K 7090, HELIOGEN® Blue L 7101 F, HELIOGEN® Blue L6900, L7020, HELIOGEN® Blue D6840, HELIOGEN® Blue D7080, HELIOGEN® Green L8730, HELIOGEN® Green K 8683, HELIOGEN® Green L 9140, CHROMOPHTAL® Yellow 3G, CHROMOPHTAL® Yellow GR, CHROMOPHTAL® Yellow 8G, IGRAZIN® Yellow 5GT, IGRALITE® Rubine 4BL, IGRALITE® Blue BCA, MONASTRAL® Magenta, MONASTRAL® Scarlet, MONASTRAL® Violet R, MONASTRAL® Red B, and MONASTRAL® Violet Maroon B. Still other suitable pigments are available from Heubach Group: DALAMAR® Yellow YT-858-D and HEUCOPHTHAL® Blue G XBT-583D; and from Hoechst Specialty Chemicals: Permanent Yellow GR, Permanent Yellow G, Permanent Yellow DHG, Permanent Yellow NCG-71, Permanent Yellow GG, Hansa Yellow RA, Hansa Brilliant Yellow 5GX-02, Hansa Yellow-X, NOVOPERM® Yellow HR, NOVOPERM® Yellow FGL, Hansa Brilliant Yellow 10GX, Permanent Yellow G3R-01, HOSTAPERM® Yellow H4G, HOSTAPERM® Yellow H3G, HOSTAPERM® Orange GR, HOSTAPERM® Scarlet GO, HOSTAPERM® Pink E, Permanent Rubine F6B, and the HOSTAFINE® series. The following pigments are available from Mobay Corp.: QUINDO® Magenta, INDOFAST® Brilliant Scarlet, QUINDO® Red R6700, QUINDO® Red R6713, and INDOFAST® Violet; and from Sun Chemical Corp.: L74-1357 Yellow, L75-1331 Yellow, and L75-2577 Yellow.

Other examples of suitable pigments may include Normandy Magenta RD-2400, Permanent Violet VT2645, Argyle Green XP-111-S, Brilliant Green Toner GR 0991, Sudan Blue OS, PV Fast Blue B2GO1, Sudan III, Sudan II, Sudan IV, Sudan Orange G, Sudan Orange 220, Ortho Orange OR 2673, Lithol Fast Yellow 0991 K, Paliotol Yellow 1840, Lumogen Yellow D0790, Suco-Gelb L1250, Suco-Yellow D1355, Fanal Pink D4830, Cinquasia Magenta, Lithol Scarlet D3700, Toluidine Red, Scarlet for Thermoplast NSD PS PA, E. D. Toluidine Red, Lithol Rubine Toner, Lithol Scarlet 4440, Bon Red C, Royal Brilliant Red RD-8192, Oracet Pink RF, and Lithol Fast Scarlet L4300. These pigments are available from commercial sources such as Hoechst Celanese Corporation, Paul Uhlich, BASF, American Hoechst, Ciba-Geigy, Aldrich, DuPont, Ugine Kuhlman of Canada, Dominion Color Company, Magruder, and Matheson. Examples of other suitable colored pigments are described in the Colour Index, 3rd edition (The Society of Dyers and Colourists, 1982).

It is to be understood that the above-mentioned pigments may be used singly or in a combination of two or more. A typical size of these pigments ranges from about 10 nm to about 10 μm in diameter, and in one example, ranges from 10 nm to about 500 nm in diameter. Other sizes outside this range may be used if the pigment can remain dispersed and provide adequate color properties. In one example, the pigment may be included in an amount ranging from about 1% to about 20% by weight of the inkjet ink composition, and often may be included in an amount ranging from about 2% to about 6% by weight of the inkjet ink composition.

As mentioned above, the pigments in the inkjet inks may have a dispersant attached thereto. An example of the dispersant can include a carboxylic acid. Reactive groups such as alcohol, amine, anhydride, sulfonic acid, thiol, halotriazine, maleimide and vinyl sulfone, or the like may also be used. Examples of broad classes of suitable dispersants include polyalkyl glycols, polyalkyl imines, aryl dicarboxylic acids, such as phthalic acids, isophthalic acids, terephthalic acids, carbohydrates, acrylates, methacrylates, trehalose, or isomers thereof, and combinations thereof.

In an example, a glycol dispersant or an imine dispersant may be desirable. Glycol dispersants tend to be stable at neutral and higher pH, while imine dispersants tend to be stable at lower pH, e.g., about 4-6. In an example, the dispersant may be polyethylene glycol. Dispersants may help to improve dispersion stability, but may also improve bleed control. Examples of other suitable dispersants include polypropylene glycol, polyethylene imine, trehalose, and combinations thereof.

In some examples, the pigment may have a polymer coupled thereto, where the polymer is also coupled to a dispersant. In these examples, the pigment is polymer-dispersed.

It is to be understood that dye based colorant inkjet printing, dye based offset printing, and dye based sublimation printing is sensitive to UV and ozone fading under standard operating conditions. As such, it may be more desirable to utilize dry or liquid electrophotographic printing and/or pigment based inkjet printing as disclosed herein.

Referring back to FIG. 3A and as mentioned above, the image receiving medium 20 may be the same shape and size as the foldable material 12. As such, the image receiving medium 20 may have an image receiving portion 26 that is shaped and sized in the same manner as the face portion 14 of the foldable material 12, and image receiving extensions $\mathbf{28}_A$, $\mathbf{28}_B$, $\mathbf{28}_C$, $\mathbf{28}_D$ that respectively extend from each side $\mathbf{26}_A$, $\mathbf{26}_B$, $\mathbf{26}_C$, $\mathbf{26}_D$ of the image receiving portion 26. The image receiving extensions $\mathbf{28}_A$, $\mathbf{28}_B$, $\mathbf{28}_C$, $\mathbf{28}_D$ may also receive a portion of the image 22 during printing, if that is desirable. As shown in FIG. 3A, the image receiving extensions $\mathbf{28}_A$, $\mathbf{28}_B$, $\mathbf{28}_C$, $\mathbf{28}_D$ may be scored with fold lines 18 that match the fold lines 18 of the underlying foldable extensions $\mathbf{16}_A$, $\mathbf{16}_B$, $\mathbf{16}_C$, $\mathbf{16}_D$. In this example, the four fold lines 18 of the image receiving extensions $\mathbf{28}_A$, $\mathbf{28}_B$, $\mathbf{28}_C$, $\mathbf{28}_D$ define four respective tabs 5, 6, 7, 8 that correspond with the tabs 1, 2, 3, 4 of the underlying foldable material 12.

In other examples not shown in the figures, the image receiving medium 20 may be the same shape and size as the face portion 14. In this example, the image receiving medium 20 would not include image receiving extensions $\mathbf{28}_A$, $\mathbf{28}_B$, $\mathbf{28}_C$, $\mathbf{28}_D$. In still another example not shown in the figures, the image receiving medium 20 may be the same shape and size as the face portion 14 and the innermost tab 1 of each of the foldable extensions $\mathbf{16}_A$, $\mathbf{16}_B$, $\mathbf{16}_C$, $\mathbf{16}_D$.

After the image 22 is printed on the image receiving medium 20, the image receiving medium 20 is adhered to the foldable material 12. As shown more clearly in FIG. 3B, the entire surface of the foldable material 12 (including the opposed surface 13 of the face portion 14 and the surfaces of the tabs 1, 2, 3, 4 of the foldable extensions $\mathbf{16}_A$, $\mathbf{16}_B$, $\mathbf{16}_C$, $\mathbf{16}_D$) is coated with the adhesive layer 24, which adheres the image receiving medium 20 to the foldable material 12.

The adhesive layer 24 may be pre-coated onto the foldable material 12 (e.g., on the surface 13 and the surfaces of the foldable extensions $\mathbf{16}_A$, $\mathbf{16}_B$, $\mathbf{16}_C$, $\mathbf{16}_D$), and may have a removable/release liner (not shown) attached thereto. The adhesive layer 24 may be applied to the foldable material 12 using an air knife coater, a rod coater, a slot die coater, or a film transfer coater. In one example, the adhesive layer 24 is applied directly onto a release liner (not shown), and then the glued release liner is laminated onto the foldable material 12 using a laminator. The removable liner may protect the adhesive layer 24 from contamination and from prematurely adhering.

The release liner may include a substrate and release coating deposited on the release coating. The substrate may be a cellulose paper and/or a polymeric film, such as polyethylene, polypropylene or polyethylene terephthalate (PET). The release coating is made of material(s) that is/are readily able to delaminate from the adhesive layer 24 and do not migrate or transfer to the released material (adhesive layer 24) to any significant degree. Examples of the release coating of the release liner include polyacrylates, carbamates, polyolefins, fluorocarbons, chromium stearate complexes and silicones. In one example, the silicones release coating may be desirable, at least in part because it can easily be applied on various substrates and can be cured into a polydimethylsiloxane (PDMS) network, which limits migration into an adhesive matrix. Silicones may also allow substantially lower release forces than other materials.

When it is desirable to attach the printed-on image receiving medium 20 to the foldable material 12, the removable liner may be removed and the medium 20 may be aligned with and secured to the foldable material 12.

In an example, the adhesive layer 24 has a thickness ranging from about 30 μm to about 450 μm. If the adhesive layer thickness is less than 30 μm, the internal stress generated between the image receiving medium 20 and the foldable material 12 may cause adhesion failure. Examples of suitable adhesives include acrylate polymer adhesives. In some instances, the adhesive layer 24 exhibits a pressure sensitivity property. This property provides an adhesion strength between two adhered surfaces, for example, when a moderate pressure is applied (e.g., by hands).

When the image receiving medium 20 is the same size and shape as the face portion 14 alone, the adhesive layer 24 may be deposited on the entire surface 13, but may not be deposited on the surfaces of the foldable extensions $\mathbf{16}_A$, $\mathbf{16}_B$, $\mathbf{16}_C$, $\mathbf{16}_D$. Alternatively, in this example, the adhesive layer 24 may be deposited on the entire surface 13 and the outermost tab 4 of each foldable extension $\mathbf{16}_A$, $\mathbf{16}_B$, $\mathbf{16}_C$, 16. This may be desirable to adhere the image receiving medium 20 to the surface 13 alone and to use the adhesive on the outermost tabs 4 for adhering the tabs 4 when the foldable material 12 is folded (as shown in FIG. 4A). When the image receiving medium 20 is the same size and shape as the face portion 14 and the innermost tab 1 of the foldable extensions $\mathbf{16}_A$, $\mathbf{16}_B$, $\mathbf{16}_C$, $\mathbf{16}_D$, the adhesive layer 24 may be formed on the entire surface 13 and the surface of the innermost tab 1 of each foldable extension $\mathbf{16}_A$, $\mathbf{16}_B$, $\mathbf{16}_C$, $\mathbf{16}_D$. Alternatively, in this example, the adhesive layer 24 may be deposited on the entire surface 13, the innermost tab 1 of each foldable extension $\mathbf{16}_A$, $\mathbf{16}_B$, $\mathbf{16}_C$, $\mathbf{16}_D$, and the outermost tab 4 of each foldable extension $\mathbf{16}_A$, $\mathbf{16}_B$, $\mathbf{16}_C$, $\mathbf{16}_D$. This may be desirable to adhere the image receiving medium 20 to the surface 13 and the innermost tabs 1 (which will be viewable from the side when the final clock is formed) and to use the adhesive on the outermost tabs 4 for adhering the tabs 4 when the foldable material 12 is folded (as shown in FIG. 4A). It is to be understood that in these examples, removable/release liners may be positioned on the adhesive layer (s) 24 until it is desirable to adhere the image receiving medium 20 and/or to adhere the tabs 4 during folding.

After the image receiving medium 20 is adhered to all or a portion of the foldable material 12, rubber rollers may be used to apply force to the adhered materials 12, 20 to remove any air bubbles entrapped between the adhered materials 12, 20.

The foldable material 12 (and in some instances the image receiving medium 20) is/are folded to form the frame portions $\mathbf{30}_A$, $\mathbf{30}_B$, $\mathbf{30}_C$, $\mathbf{30}_D$ and the three-dimensional supporting frame 32, as shown in FIG. 4A. To construct the three-dimensional supporting frame 32, tabs 1 and 5 of each of the extensions $\mathbf{16}_A$, $\mathbf{16}_B$, $\mathbf{16}_C$, $\mathbf{16}_C$ and $\mathbf{28}_A$, $\mathbf{28}_B$, $\mathbf{28}_C$, $\mathbf{28}_C$ are folded inward (i.e., towards the surface 15 of the face portion 14). The tabs 1 and 5 of a respective extension $\mathbf{16}_A$ and $\mathbf{28}_A$, or $\mathbf{16}_B$ and $\mathbf{28}_B$, or $\mathbf{16}_C$ and $\mathbf{28}_C$, or $\mathbf{16}_C$ and $\mathbf{28}_C$ form an outer wall of the respective frame portion $\mathbf{30}_A$, $\mathbf{30}_B$, $\mathbf{30}_C$, or $\mathbf{30}_C$. All together, the tabs 1 and 5 form the perimeter wall of the three-dimensional supporting frame 32. Tabs 2 and 6 of each of the extensions $\mathbf{16}_A$, $\mathbf{16}_B$, $\mathbf{16}_C$, $\mathbf{16}_C$ and $\mathbf{28}_A$, $\mathbf{28}_B$, $\mathbf{28}_C$, $\mathbf{28}_C$ are folded inward (i.e., towards the surface 15 of the face portion 14). The tabs 2 and 6 of a respective extension $\mathbf{16}_A$ and $\mathbf{28}_A$, or $\mathbf{16}_B$ and $\mathbf{28}_B$, or $\mathbf{16}_C$ and $\mathbf{28}_C$, or $\mathbf{16}_C$ and $\mathbf{28}_C$ form a back surface of the respective frame portion $\mathbf{30}_A$, $\mathbf{30}_B$, $\mathbf{30}_C$, or $\mathbf{30}_C$. All together, the tabs 2 and 6 form the back surface of the three-dimensional supporting frame 32. Tabs 3 and 7 of each of the extensions $\mathbf{16}_A$, $\mathbf{16}_B$, $\mathbf{16}_C$, $\mathbf{16}_C$ and $\mathbf{28}_A$, $\mathbf{28}_B$, $\mathbf{28}_C$, $\mathbf{28}_C$ are then folded inward (i.e., towards the surface 15 of the face portion 14). The tabs 3 and 7 of a respective extension $\mathbf{16}_A$ and $\mathbf{28}_A$, or $\mathbf{16}_B$ and $\mathbf{28}_B$, or $\mathbf{16}_C$ and $\mathbf{28}_C$, or $\mathbf{16}_C$ and $\mathbf{28}_C$ form an inner wall of the respective frame portion $\mathbf{30}_A$, $\mathbf{30}_B$, $\mathbf{30}_C$, or $\mathbf{30}c$. All together, these tabs 3 and 7 form the inner perimeter wall of the three-dimensional supporting frame 32. Finally, tabs 4 and 8 of each of the extensions $\mathbf{16}_A$, $\mathbf{16}_B$, $\mathbf{16}_C$, $\mathbf{16}_C$ and $\mathbf{28}_A$, $\mathbf{28}_B$, $\mathbf{28}_C$, $\mathbf{28}_C$ are then folded inward (i.e., towards the surface 15 of the face portion 14). These tabs 4, 8 are adhered, or otherwise secure to, the surface 15 of the face portion 14 of the foldable material 12.

Figure 4B:
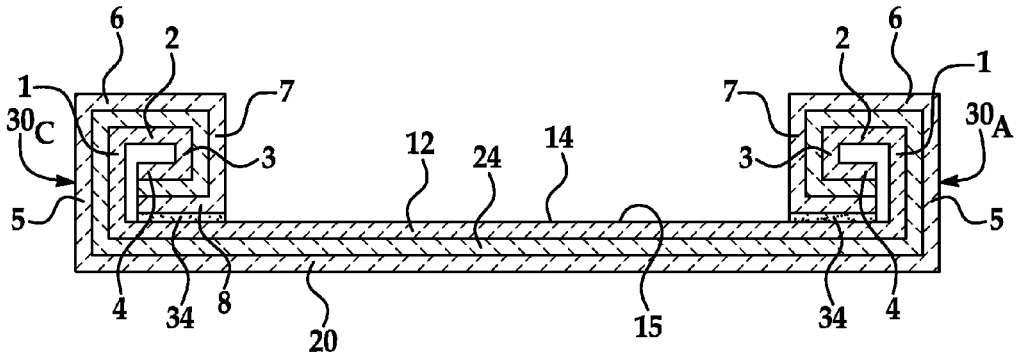
FIG. 4B is a cross-sectional view taken along the 4B-4B line of FIG. 4A.

An example of the adhesive 34 used to secure the tabs 4, 8 to the surface 15 is shown in FIG. 4B (i.e., the cross-sectional view). Any adhesive previously described may be utilized for the adhesive 34. When folding the tabs, adhesive may be applied to tab 4 or tab 8 (whichever tab is present as the outermost tab) and then adhered to the surface 15.

Once tabs 4, 8 are secured, the frame portions $\mathbf{30}_A$, $\mathbf{30}_B$, $\mathbf{30}_C$, or $\mathbf{30}_D$ and the three-dimensional supporting frame 32 are formed.

As illustrated in FIG. 4B, when the image receiving medium 20 covers the entire foldable material 12 (including foldable extensions $\mathbf{16}_A$, $\mathbf{16}_B$, $\mathbf{16}_C$, $\mathbf{16}_D$) and the materials 12 and 20 are folded, the tabs 5, 6, 7, 8 will be viewable (e.g., tabs 5, 6, 7) and adhered to the surface 15 (e.g., tab 8). In other instances, for example, when the image receiving medium 20 covers the face portion 14 alone and the material 12 is folded, the tabs 1, 2, 3, 4 will be viewable (e.g., tabs 1, 2, 3) and adhered to the surface 15 (e.g., tab 4). In still other instances, the image receiving medium 20 may be visible along the perimeter wall of the three-dimensional supporting frame 32 (i.e., tab 5 is present), and the foldable material 12 may be visible along the other areas (back surface and inner wall) of the frame portions $\mathbf{30}_A$, $\mathbf{30}_B$, $\mathbf{30}_C$, or $\mathbf{30}_D$.

While not shown, it is to be understood that a support material may be inserted into the supporting frame 32 adjacent to the surface 15 of the face portion 14. The support material may be cardboard or another strengthening material that adds support, but not significant weight, to the structure. The support material may or may not be adhered to the face portion 14.

Figure 5:
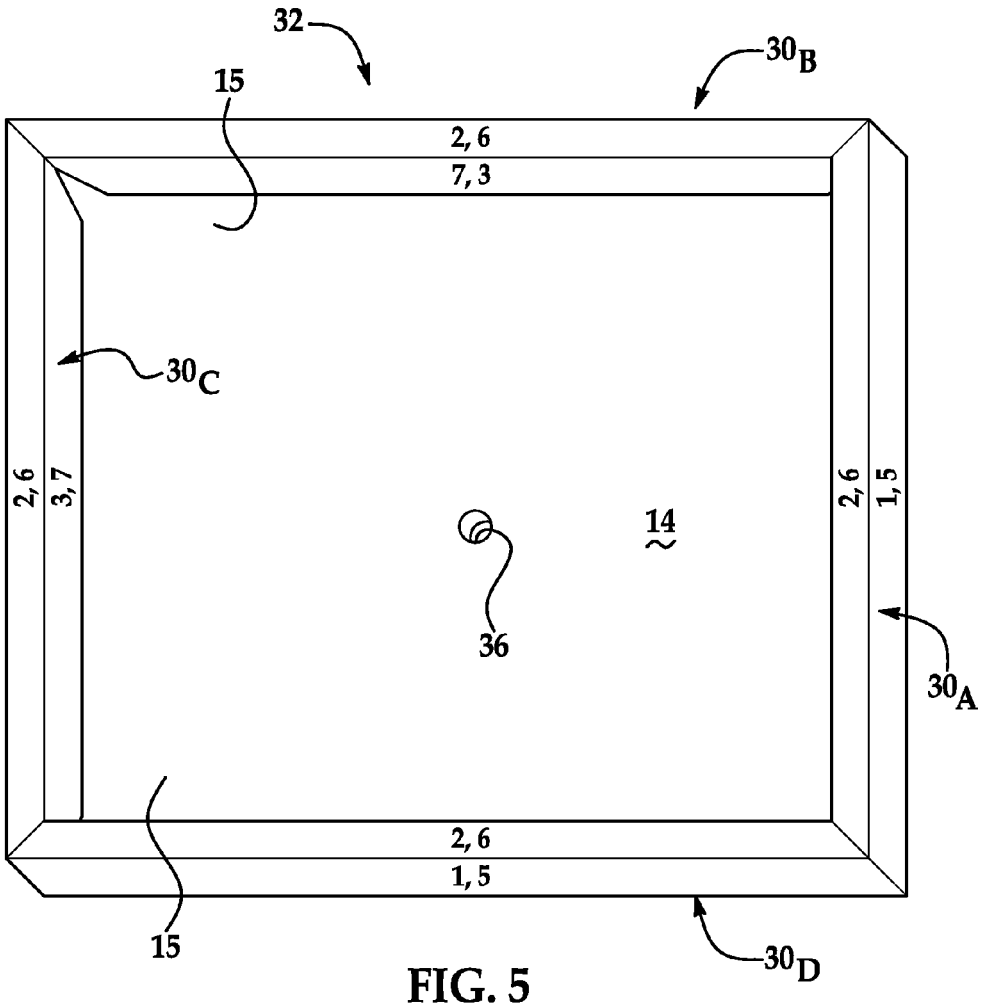
FIG. 5 is a back, perspective view of the three-dimensional supporting frame of FIG. 4A showing a hole formed therein.

Referring now to FIG. 5, once the material 12 or the materials 12 and 20 is/are folded, an aperture 36 may be formed through the foldable material 12 and the image receiving medium 20 (and if present, through the support material). Any tool may be used to form the aperture 36. In an example, the desired size hole/aperture 36 is punched through the foldable material 12 and the image receiving medium 20. A tool may be used that has a pointed end and a stepped diameter. In an example, the piercing begins at the pointed end of the tool, and as the tool is pushed through the materials 12, 20, the aperture 36 is enlarged. The tool is pressed through the materials 12, 20 until the stepped diameter comes into contact with the medium 20 (e.g., assuming aperture formation begins through the foldable material 12). This insures the formation of a complete through hole/aperture with the desired diameter. In an example, the diameter of the formed aperture 36 ranges from about 8 mm to about 9.5 mm. If the diameter of the aperture 36 is too small, a bushing (discussed below) cannot be pressed into the aperture 36, and if the diameter is too large, there may not be enough rotational friction to secure the bushing. While the aperture 36 is shown near the center of the face portion 14, it is to be understood that the aperture 36 may be formed at any area on the face portion 14 within the frame portions $\mathbf{30}_A$, $\mathbf{30}_B$, $\mathbf{30}_C$, and $\mathbf{30}_D$. The area at which the aperture 36 is formed will depend, at least in part, upon where it is desirable for the hand-moving mechanism (reference numeral 38 in FIG. 6B) and clock hand(s) (reference numerals 54, 56, 58 in FIG. 7) to be positioned on the final clock 10.

It is to be understood that in some examples, the apertures 36 in the respective materials 12 and 20 may be formed before the materials 12 and 20 are adhered together. This may further aid in accurately aligning the foldable material 12 and the image receiving medium 20.

Figure 6A:
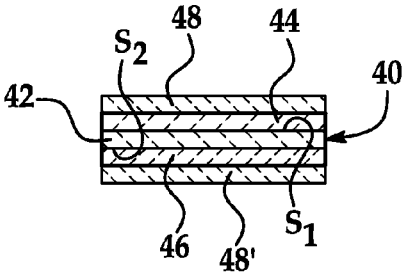
FIG. 6A is a cross-sectional view of a pad.
Figure 6C:
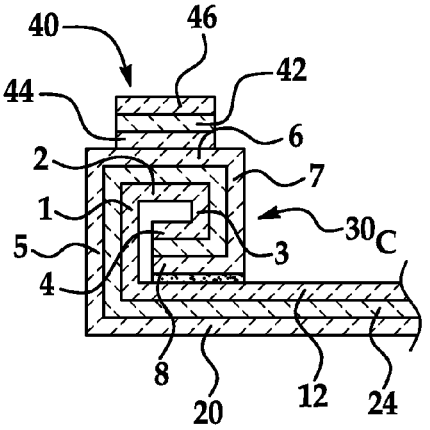
FIG. 6C is a cross-sectional view taken along the 6C-6C line of FIG. 6B.
Figure 6B:
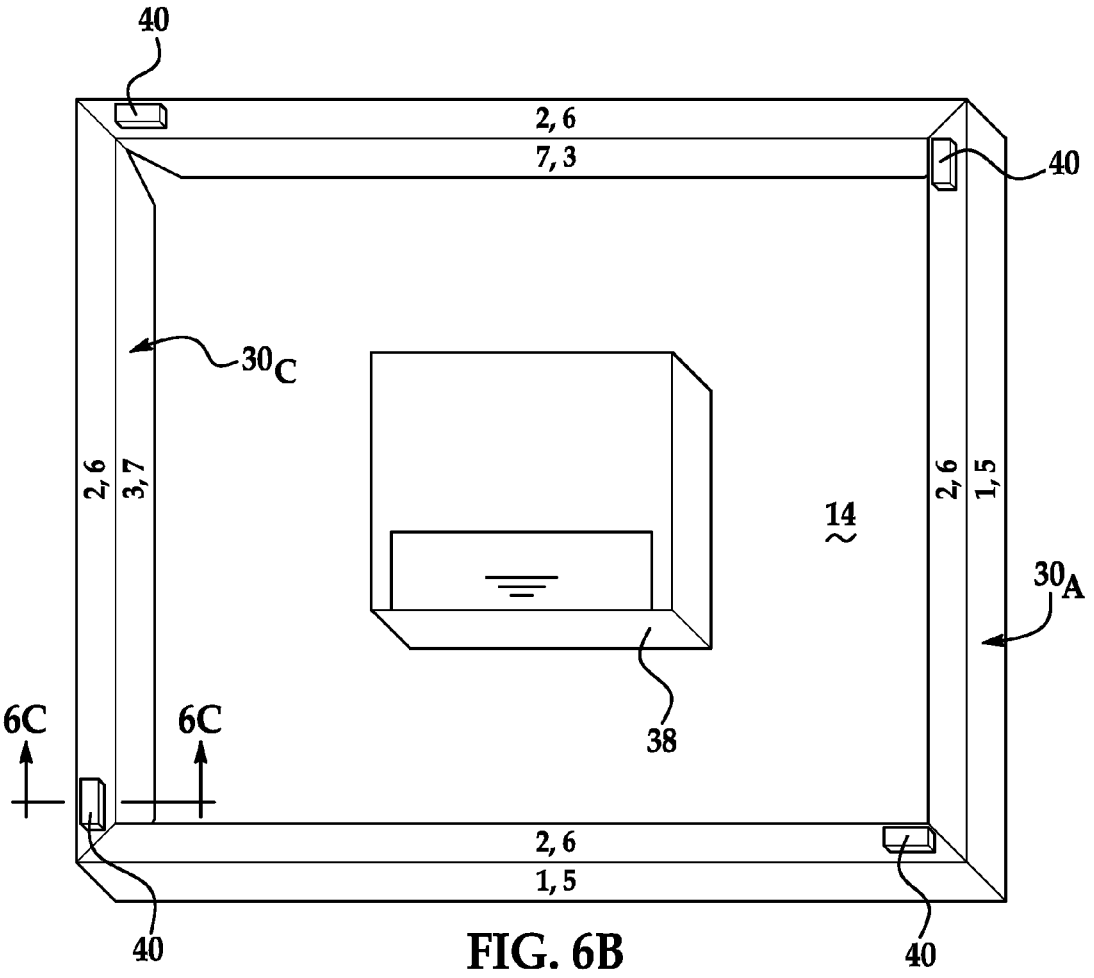
FIG. 6B is a back, perspective view of the three-dimensional supporting frame of FIG. 5 showing an example of a hand-moving mechanism mounted to the frame so that it covers the hole, and showing examples of the pads of FIG. 6A adhered to the three-dimensional supporting frame.

Pads 40 may be adhered to the back surface of the supporting frame 32 (see FIGS. 6B and 6C). In one example, a pad 40 is adhered to the back surface (e.g., tabs 2, 6) of each frame member $\mathbf{30}_A$, $\mathbf{30}_B$, $\mathbf{30}_C$, $\mathbf{30}_D$ so that the supporting frame 32 has a pad 40 in each corner. In some instances, the pads 40 overlap from one frame member $\mathbf{30}_A$, $\mathbf{30}_B$, $\mathbf{30}_C$, $\mathbf{30}_D$ to an adjacent frame member $\mathbf{30}_A$, $\mathbf{30}_B$, $\mathbf{30}_C$, $\mathbf{30}_D$. It is understood that pads 40 may be placed in different configurations, depending, at least in part, on the shape of the supporting frame 32.

A cross-sectional view of one pad 40 is shown in FIG. 6A. In an example, the pad 40 is designed to reinforce the supporting frame 32 and provide a repositionable property to personalized wall clock 10. As illustrated in FIG. 6A, the pad 40 includes at least three layers. The middle of the pad 40 includes a substrate 42 having two opposed surfaces $S_1$, $S_2$. The substrate 42 may be any suitable material, such as cellulose paper, a polymeric film, a natural or synthetic fabric. More specific examples of the substrate 42 include a paper board with base weight of about 150 gsm to about 400 gsm, a polymeric film made of high-density polyethylene (HDPE), polypropylene (PP), polyethylene terephthalate (PET) or other suitable polymers; or a woven or non-woven fabric formed from natural cottons or polymeric PET fibers. Adjacent to one surface $S_1$ of the substrate 42 is an adhesive film layer 44, which may be the same adhesive as the adhesive layer 24. The adhesive film layer 44 may also be different from the adhesive layer 24. For example, the adhesive layer 44 may include adhesives based on chemical molecules, such as polyvinyl alcohol, polyvinyl acetate, ethylene-vinyl acetate copolymers, ethylene-vinyl alcohol copolymers, polyamide, polyimide, epoxies and polyacrylates.

A repositionable adhesive 46 is adjacent to the other surface $S_2$ of the substrate 42. The repositionable adhesive 46 is constructed so that the clock 10 may be removed from a wall and may be placed back on the same wall or moved to another wall (e.g., when changing a battery, adjusting the time, etc.). The repositionable adhesive 46 may be formed of a polymeric resin matrix having micro-particles dispersed therein. The polymeric resin matrix is selected from polymeric compounds which have a significant viscoelasticity, which exhibit a time depended strain when undergoing a stressed deformation. The example of viscoelastic resins include poly vinyl ethers, silicone resin, polyacrylic resins, nitrile rubbers, butyl rubbers ethylene-vinyl acetate copolymers, or styrene block copolymers, such as styrene-butadiene-styrene (SBS), styrene-ethylene/butylene-styrene and styrene-ethylene/propylene. The micro-particles may have a spherical or spherical-like morphology. In an example, the micro-particles are synthesized polymeric particles made by a suitable method, such as emulsion polymerization. Examples of these particles include polystyrene or polyamide particles. In another example, the micro-particles are dispersed polymeric resin particles, such as polyethylene and polypropylene wax particles, or inorganic particles made by grounding minerals or by synthesizing minerals (e.g., precipitated calcium carbonates). The micro-particles have a size ranging from about 0.5 μm to about 100 μm, or from about 5 μm to about 75 μm. The micro-particles may be pre-mixed/dispersed in the resin matrix before the resin is applied.

The repositionable adhesive 46 may be deposited with either a liquid carrier (e.g., an organic solvent or water). When this technique is used, the liquid carrier is evaporated, for example, in a dryer. In another example, the repositionable adhesive 46 may be applied in a 100% solid form. The dry repositionable adhesive 46 may be further heated to initiate a cross-linking reaction and increase molecular weight. 100% solid raw materials for making viscoelestic resins may be low viscosity oligomers that are coated and then reacted with radiation to increase molecular weight and form the adhesive 46.

As shown in FIG. 6A, removable/release liners 48 and 48' may respectively be removably secured to the adhesive film layer 44 and the repositionable adhesive 46. Examples of the removable liners 48, 48' include those examples previously discussed. The removable liner 48 may be removed when adhering the pad 40 to the supporting frame 32 (as shown in FIGS. 6B and 6C), and the removable liner 48' may be removed when adhering the clock 10 to the wall.

While not shown, it is to be understood that the pad 40 may be made without the repositionable adhesive 46. The pad 40 will still be adhered to the supporting frame 32, but the clock 10 will not be hung via the pad(s) 40. In this example, another hole (ranging from 5 mm to 10 mm in diameter) may be made in the face portion 14 in order to hang the clock 10.

FIG. 6B also shows a part of the hand-moving mechanism 38 attached to the face portion 14 at the surface 15. The hand moving mechanism 38 includes either a mechanical moving mechanism or an electrical-moving mechanism, or a combination of both. Mechanical movements use an escapement mechanism to control and limit the unwinding and winding parts of a spring, converting what would otherwise be a simple unwinding into a controlled and periodic energy release. The electrical mechanism uses quartz vibrations or electromagnetic pulses (i.e., quartz movements) to indicate time. The combination mechanical and electrical mechanism uses quartz movements but is geared to drive mechanical hands on the face to provide a traditional analog display of the time.

In an example, the combination mechanical and electrical mechanism is used. The hand hand-moving mechanism 38 may include a battery operated quartz oscillator coupled with a mechanical moving hands assembly. It is to be understood that any quartz oscillator that can provide the timely movement of revolving shafts and hands operatively connected thereto may be used. As illustrated in FIG. 6B, the quartz oscillator assembly of the hand-moving mechanism 38 is secured to the face portion 14 at surface 15, as will be described further below.

Figure 7:
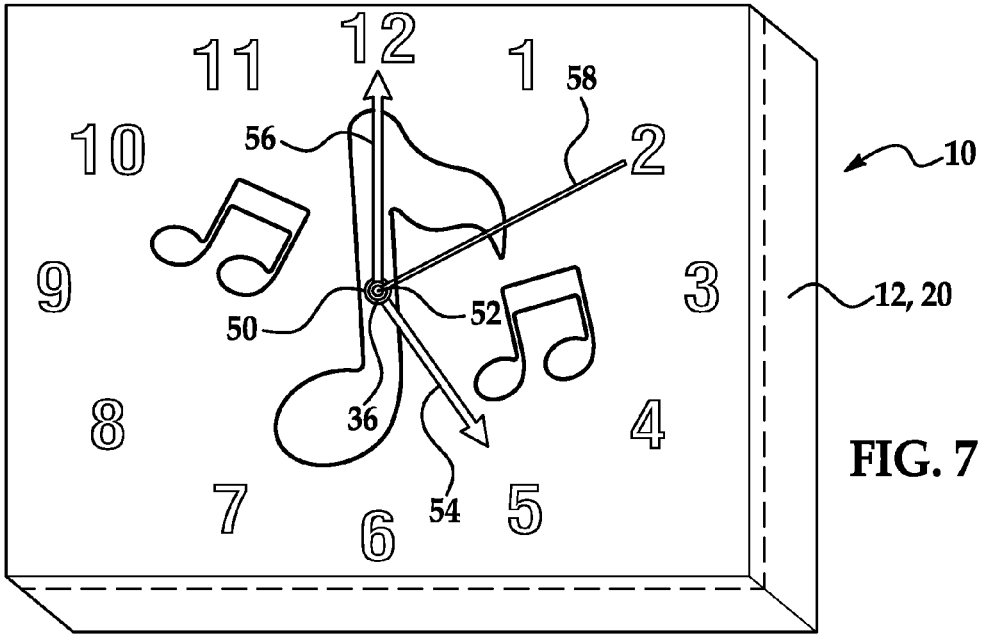
FIG. 7 is a top, perspective view of an example of a personalized wall clock.

FIG. 7 illustrates the clock 10 after the hand-moving mechanism 38 has been attached. In addition to the quartz oscillator assembly, the hand-moving mechanism also includes a flange bushing 50 that is inserted into the aperture 36. The desired size aperture 36 creates an interference fit with the flange bushing 50. This insures that the bushing 50, once pressed into position, will allow enough rotational friction to hold the hands of the mechanism 38 sufficiently in place. As such, the flange bushing 50 creates a clean aperture 36 for the movement of the revolving shaft(s)) and also covers any ragged edges of the aperture 36.

Once the flange bushing 50 has been pressed into the punched aperture 36, a quartz oscillator threaded shaft 52 is inserted from the back side (e.g., from surface 15) of the clock 10, through the flange bushing 50 and is held in place by attaching a washer and hex nut to the threaded shaft 52. In an example, the quartz oscillator is rotated so that the battery area of the quartz oscillator is in the 6 o'clock position with respect to the face of the clock 10. The nut is then tightened, which brings the quartz oscillator unit tight to the flange bushing 50 and creates enough rotational friction to keep the quartz oscillator in position.

The hour hand 54, minute hand 56, and second hand 58 may be attached in a specific order that match areas on the exposed quartz oscillator threaded shaft 52 protruding from the clock face. The hour hand 54 may be pressed first onto a round portion of the shaft 52 protruding from the clock face. The minute hand 56, which may have a rectangular punched hole, may then be pressed onto the same shaped portion of the shaft 52 and secure with a small threaded knurled nut that is tightened onto the face of the minute sweep hand 56. The second sweep hand 58 may have a hollow shaft that is pressed onto a small receiving pin in the center of the oscillator shaft 52.

As shown in FIG. 7, the clock 10 is personalized with the user-selected image 22, including the graphic(s) and the numbers for the clock. It is to be understood that other photos, graphics, and/or number representations may be selected and printed on the image receiving medium 20 to form the personalized clock 10. The composition of the image receiving medium 20 is such that the medium 20 need not be covered, for example, by glass, plastic, etc.

It is to be understood that the ranges provided herein include the stated range and any value or sub-range within the stated range. For example, a range from about 20 μm to about 50 μm should be interpreted to include not only the explicitly recited limits of about 20 μm to about 50 μm, but also to include individual values, such as 21 μm, 45 μm, etc., and sub-ranges, such as from about 25 μm to about 40 μm, from about 30 μm to about 35 μm, etc. Furthermore, when "about" is utilized to describe a value, this is meant to encompass minor variations (up to +/−10%) from the stated value.

While several examples have been described in detail, it will be apparent to those skilled in the art that the disclosed examples may be modified. Therefore, the foregoing description is to be considered non-limiting.

What is claimed is:

1. A kit for making a personalized wall clock, comprising:
- an image receiving medium to receive a personalized digital printed image thereon, the image receiving medium including a digital ink/toner receiving layer or having a digital ink/toner receiving surface structure;
- a foldable material, including:
  - a face portion having two opposed surfaces and at least four sides, one of the two opposed surfaces to receive the image receiving medium; and
  - a foldable extension extending from each side of the face portion, each of the foldable extensions including four scored fold lines that respectively define four tabs, and each of the foldable extensions to be folded no less than four times toward an other of the two opposed surfaces to form a three-dimensional supporting frame, wherein an outermost tab of the four tabs is to be directly or indirectly adhered to the other of the two opposed surfaces; and
- a hand-moving mechanism.

2. The kit as defined in claim 1, further comprising a pad to be adhered to the three-dimensional supporting frame, the pad including:
- a substrate having first and second opposed surfaces;
- an adhesive layer on the first of the opposed surfaces;
- a release liner on the adhesive layer;
- a repositionable adhesive on the second of the opposed surfaces; and
- a release liner on the repositionable adhesive.

3. The kit as defined in claim 2 wherein the repositionable adhesive includes a polymeric resin matrix with microparticles dispersed therein.

4. The kit as defined in claim 1 wherein the image receiving medium is chosen from:
- a cellulose paper coated with the digital ink/toner receiving layer including a binder and an inorganic particle;
- a polymeric film coated with the digital ink/toner receiving layer including a binder and an inorganic particle; and
- a metal foil substrate coated with the digital ink/toner receiving layer including a binder and an inorganic particle.

5. The kit as defined in claim 4 wherein the digital ink/toner receiving layer further includes an ultraviolet light absorbing material, a luminous material, or combinations thereof.

6. The kit as defined in claim 1 wherein the image receiving medium has the digital ink/toner receiving surface structure, and wherein the digital ink/toner receiving surface structure is formed from corona treatment, plasma grafting polymerization, calendering, or acid etching.

7. The kit as defined in claim 1 wherein each foldable extension includes four tabs, and wherein the kit further includes:
- an adhesive layer established on each of i) a surface of each of the four tabs; ii) the one of the two opposed surfaces; and
- a removable liner positioned on the adhesive layer.

8. The kit as defined in claim 7 wherein the adhesive layer is a continuous layer that has a thickness ranging from about 30 μm to about 450 μm.

9. The kit as defined in claim 1 wherein:

the image receiving medium and the foldable material are the same size and the same shape; and each of the image receiving medium and the face portion has the hole formed therein so that the respective holes align when the image receiving medium is adhered to the face portion.

10. The kit as defined in claim 1, further comprising an adhesive layer pre-coated onto one of the two opposed surfaces of the foldable material.

11. The kit as defined in claim 1 wherein the foldable material has a stiffness ranging from about 1000 Taber units to 2500 Taber units.

12. A personalized wall clock, comprising:

a three-dimensional supporting frame, including:

a flat portion having two opposed surfaces and at least four sides; and folded extensions forming a frame portion at each of the at least four sides, each foldable extension folded four times along four scored fold lines toward one of the two opposed surfaces, the four scored fold lines respectively defining four tabs, wherein an outermost of the four tabs is directly or indirectly adhered to the one of the two opposed surfaces;

an image receiving medium adhered to at least an other of the two opposed surfaces of the flat portion, the image receiving medium including a digital ink/toner receiving layer or having a digital ink/toner receiving surface structure;

a personalized image printed on the image receiving medium; and a hand-moving mechanism, including:

an oscillator assembly mounted to the other of the two opposed surfaces of the flat portion;

a bushing extending through a hole in the flat portion and the image receiving medium;

an hour hand and a second hand; and a shaft operatively connecting the hour hand and the second hand to the oscillator assembly.

13. The personalized wall clock as defined in claim 12, further comprising a support material inserted into the three-dimensional supporting frame.

14. The personalized wall clock as defined in claim 12, further comprising a pad adhered to each of the folded extensions of the three-dimensional supporting frame, each pad including:

a substrate having first and second opposed surfaces;

an adhesive layer on the first of the opposed surfaces; and a repositionable adhesive on the second of the opposed surfaces, the repositionable adhesive including a polymeric resin matrix with micro-particles dispersed therein.

15. The personalized wall clock as defined in claim 12 wherein the image receiving medium is chosen from:

a cellulose paper coated with the digital ink/toner receiving layer including a binder and an inorganic particle;

a polymeric film coated with the digital ink/toner receiving layer including a binder and an inorganic particle; and a metal foil substrate coated with the digital ink/toner receiving layer including a binder and an inorganic particle.

16. The personalized wall clock as defined in claim 15 wherein the digital ink/toner receiving layer also includes an ultraviolet light absorbing material, a luminous material, or combinations thereof.

17. The personalized wall clock as defined in claim 12 wherein:

the personalized image is a user-selected graphic, text, image generated from a photograph, or combinations thereof; and the personalized image is printed using a digital printer chosen from an inkjet printer, an electrophotographic printer, and a liquid electrophotographic printer.

18. The personalized wall clock as defined in claim 12 wherein:

the image receiving medium and the foldable material are the same size and the same shape;

an outermost tab of the image receiving medium is directly adhered to the to one of the two opposed surfaces; and the outermost of the four tabs is directly adhered to the outermost tab of the image receiving medium.

19. The personalized wall clock as defined in claim 12 wherein the foldable material has a stiffness ranging from about 1000 Taber units to 2500 Taber units.

* * * * *